US009227146B1

(12) United States Patent
Giunta

(10) Patent No.: US 9,227,146 B1
(45) Date of Patent: Jan. 5, 2016

(54) NOVELTY CHOMPING DEVICE

(71) Applicant: Edward F. Giunta, Tampa, FL (US)

(72) Inventor: Edward F. Giunta, Tampa, FL (US)

( * ) Notice: Subject to any disclaimer, the term of this patent is extended or adjusted under 35 U.S.C. 154(b) by 0 days.

(21) Appl. No.: 14/702,065

(22) Filed: May 1, 2015

(51) Int. Cl.
*A63H 3/36* (2006.01)
*A63H 3/50* (2006.01)

(52) U.S. Cl.
CPC ..... *A63H 3/50* (2013.01)

(58) Field of Classification Search
USPC ..... 446/297, 298, 338, 368, 370, 371, 372, 446/376, 391, 395; 434/263
See application file for complete search history.

(56) References Cited

U.S. PATENT DOCUMENTS 2,273,836 A * 2/1942 Dale ..... A63H 3/006 40/416
2,880,408 A * 3/1959 Sewell ..... B60Q 1/44 116/37
2,931,135 A * 4/1960 Zalkind ..... A63H 33/00 446/298
4,263,743 A * 4/1981 Hanson ..... G09F 19/08 362/197
4,521,205 A * 6/1985 Spector ..... A63H 3/003 360/79
4,582,317 A * 4/1986 Provenzano, Jr. ..... A63H 11/02 446/390
4,608,771 A * 9/1986 Mehta ..... G09F 19/02 40/411
4,801,285 A * 1/1989 Yeu ..... A63H 13/12 446/298
5,108,341 A * 4/1992 DeSmet ..... A63H 3/48 446/299
5,584,741 A * 12/1996 Cheung ..... A63H 3/28 40/414
5,735,726 A * 4/1998 Cohen ..... A63H 30/00 40/414
5,781,934 A * 7/1998 Pauley, Jr. ..... A42B 1/24 2/195.1
6,145,553 A * 11/2000 Sofy ..... A45C 1/12 141/314
6,261,148 B1 * 7/2001 Robinson ..... A63H 13/12 446/298
6,478,164 B1 * 11/2002 Pan ..... A63H 13/005 211/1.51
6,500,041 B1 * 12/2002 Crome, Jr. ..... A42B 1/004 2/195.1
6,604,981 B1 * 8/2003 Sheng-Hung ..... A63H 3/28 446/338
6,699,098 B1 * 3/2004 Kau ..... A63H 11/205 446/268
7,878,878 B2 * 2/2011 Massaro ..... A63H 3/24 369/30.02
2007/0190894 A1 * 8/2007 Grisoff ..... A63H 3/006 446/298
2011/0097966 A1 * 4/2011 Kronenberg ..... A63H 3/45 446/268

* cited by examiner

*Primary Examiner* — Kurt Fernstrom
(74) *Attorney, Agent, or Firm* — Jason T. Daniel, Esq.; Daniel Law Offices, P.A.

(57) ABSTRACT

A novelty chomping device includes a skull having an upper jaw, a lower jaw and a pair of eyes that are embedded with LED's. The skull is positioned on a pedestal control box that includes a radio and speakers. An actuation unit is positioned within the control box and imparts a linear movement to the upper jaw to create a chomping motion. One or more lights are also positioned along the control box to produce an audio-visual effect.

15 Claims, 6 Drawing Sheets

NOVELTY CHOMPING DEVICE

TECHNICAL FIELD

The present invention relates generally to novelty devices, and more particularly to a novelty animal head that performs a chomping movement along with audiovisual effects.

BACKGROUND

The statements in this section merely provide background information related to the present disclosure and may not constitute prior art.

Many organizations such as universities and professional sports teams, for example, have a mascot that promotes unity and team spirit among its members.

In this regard, many individuals hang banners or wear clothing that is imprinted with an image of the mascot at social occasions such as charity tournaments, sporting events, galas, or other such times where there is a party atmosphere among the participants. At these times, the mascot is celebrated, but is not typically the center of attention.

Many mascots perform a signature dance, chop or chomping motion that is typically simple and easy for fans to emulate. For example, teams having an alligator as their mascot often imitate the characteristic chomp the animal makes with their upper and lower jaws.

Owing to the above, many fans would enjoy a novelty device that is mechanically actuated to produce, for example, a gator chomp, while simultaneously providing audiovisual entertainment. Such an item could be placed in a users home for entertainment, or can be portable, so as to be the center of attention at any social event.

Accordingly, it would be beneficial to provide a novelty chomping device that is capable of producing a chomping motion, along with audiovisual effects.

SUMMARY OF THE INVENTION

The present invention is directed to a novelty chomping device. One embodiment of the present invention can include a skull in the form of an alligator having an upper jaw, a lower jaw and a pair of eyes that are embedded with LED's.

In one embodiment, the skull can be positioned onto a pedestal control box, having a radio and speakers located therein. An actuation unit can be positioned within the control box and can provide movement to the upper jaw, so as to create a chomping motion. The control box can further include a plurality of lights which can operate in conjunction with the radio and the actuation unit to provide audiovisual stimulation to a user.

Another embodiment of the present invention can include a remote control unit which can communicate wirelessly with the device.

Yet another embodiment of the present invention can include a modulation unit which can vary the operation of the actuation unit and/or the lights based on the output of the radio.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
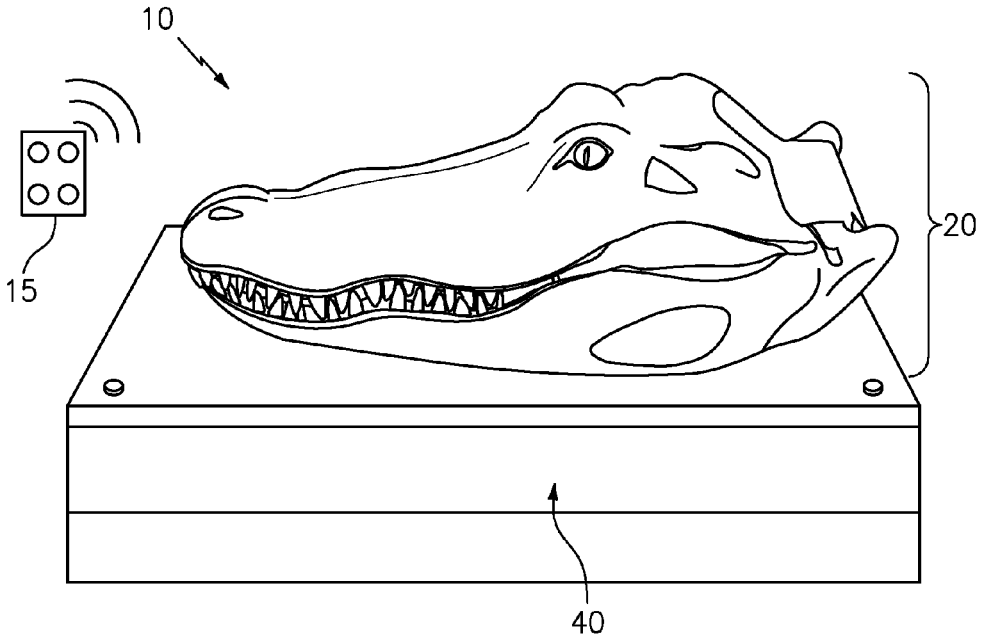
FIG. 1 is a perspective view of a novelty chomping device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described herein, the term "removably secured," and derivatives thereof shall be used to describe a situation wherein two or more objects are joined together in a nonpermanent manner so as to allow the same objects to be repeatedly joined and separated. Likewise, as described herein, a "connector" can include any number of different elements capable of securing two items together in either a permanent or a nonpermanent manner. Several nonlimiting examples include opposing strips of hook and loop material (i.e. Velcro®), two or more magnetic elements, tethers such as straps and zip ties, adhesives such as glue and resin, as well as compression fittings such as screws, nuts and bolts, among other known hardware, for example.

Although described and illustrated with respect to a genuine alligator skull, the invention is not to be construed as limiting thereto, as any number of different animal skulls can be utilized in much the same manner, and without undue experimentation. Moreover, the inventive concepts disclosed herein need not utilize a genuine skull at all, as other embodiments are contemplated wherein a replica skull and/or a stylized/cartoonish representation of the same can be utilized. In this regard, the term "skull" as used throughout this document can also refer to any number of different elements having an upper "jaw" member that can raise and lower about a lower "jaw" member, in a manner similar to that described below. One such example can include a football helmet wherein the facemask is stationary (e.g., the lower jaw) and the crown of the helmet (e.g., the upper jaw) moves, a tomahawk (e.g., the upper jaw) that moves in a manner so as to appear to chop wood (e.g., the lower jaw), and other such inanimate objects.

FIG. 1 illustrates one embodiment of a novelty animal chomping device 10 that is useful for understanding the inventive concepts disclosed herein. As shown, the device can include, essentially, a remote control unit 15, a mechanically operated skull 20, and a pedestal control box 40.

The remote control unit 15 can preferably include a battery operated device having an internal transmitter and one or more push buttons. Upon receiving a user input, the remote control unit can send a wireless signal to the below described controller 60, to initiate device functionality.

Figure 2:
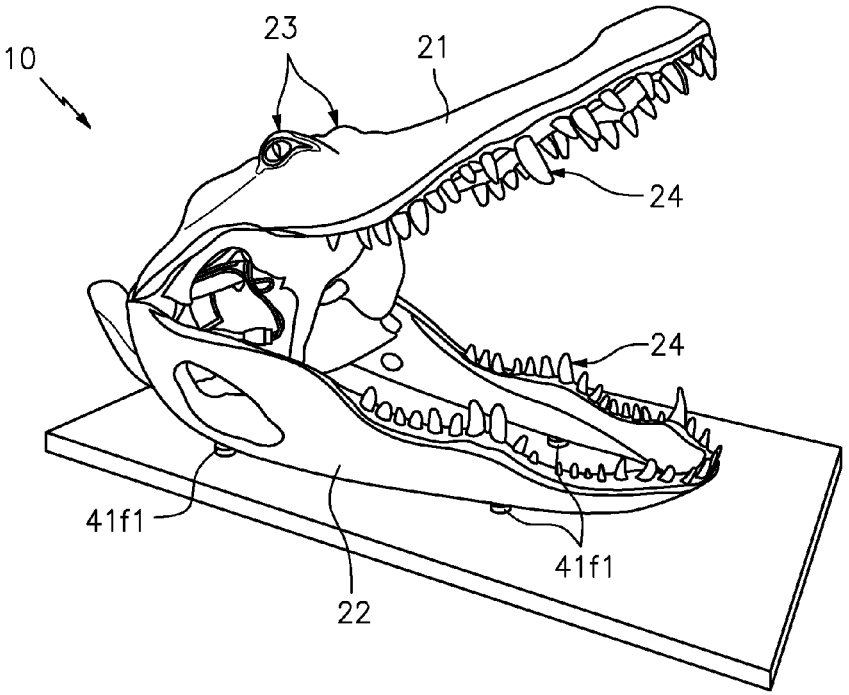
FIG. 2 is a perspective view of the skull of the novelty chomping device in an open position, in accordance with one embodiment of the invention.
Figure 3:
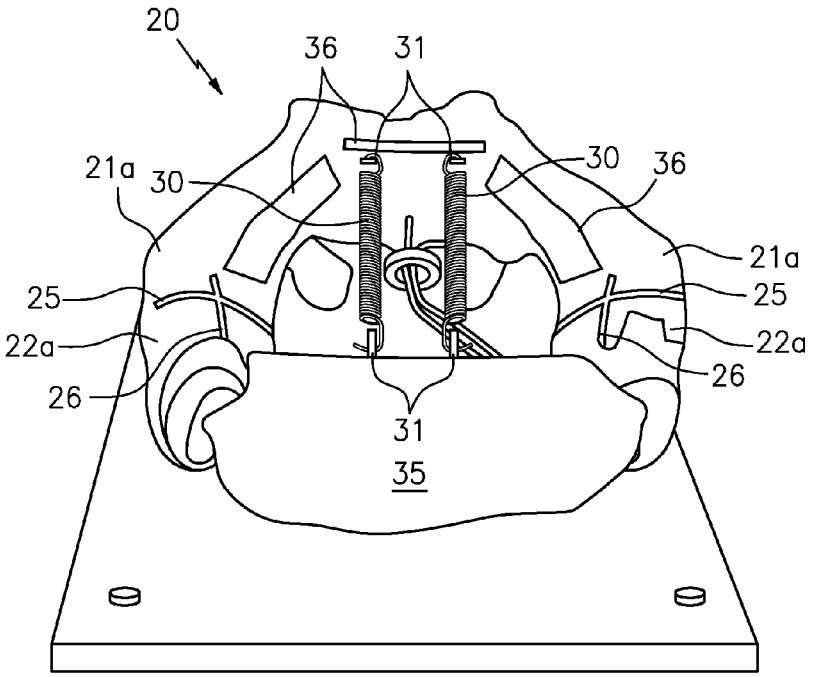
FIG. 3 is a back view of the skull of the novelty chomping device, in accordance with one embodiment of the invention.

FIGS. 2 and 3 illustrate one preferred embodiment, wherein the skull 20 is a genuine alligator skull having an upper jaw 21, a lower jaw 22, a pair of faux eyes 23, and a plurality of teeth 24 disposed along both jaws. The eyes 23 can preferably be constructed from glass or plastic and can include markings so as to appear to be genuine alligator eyes. Moreover, each of the eyes 23 can include one or more lights that are positioned adjacent to, or embedded within/behind the markings so as to be invisible to a viewer when the light(s) are not activated. The lights can be operated by the below described controller, and can function to provide a light show when the device is in operation.

As the skull is intended to articulate between an open and closed position, the skull 20 can include a pair of upper and lower jaw joints 21*a* and 22*a*, that are positioned along the rear portion of the alligator skull. In the present embodiment, the jaw joints are genuine to the alligator skull, however other embodiments are contemplated wherein artificial joints can be created and/or embedded within the jaws, so as to allow movement of the same. The jaw joints fit together much like a ball and socket, and allow the upper jaw to pivot between an open and closed orientation. In the present embodiment, a thin sheet of leather 25 or other such material can be interposed along the jaw joint surfaces. The leather sheet 25 can function as a meniscus to prevent the jaw joints from grinding together over time and causing damage to the skull.

A pair of joint tethers 26 can be connected to the rear sections of the skull at locations adjacent to the jaw joints. The tethers 26 can function to secure the joints together, and to prevent separation of the same during device operation. The tethers 26 can function much like a traditional ligament, and can also be constructed from elongated strips of leather or other such material.

A pair of extension springs 30 can be interposed between the upper and lower jaws 21 and 22 along the back side of the skull. The springs can be secured at both ends via the illustrated eye bolts 31, for example, or other such connectors. As shown, it is preferred that the springs be positioned along the central longitudinal axis of the skull, wherein they are equidistantly located to the jaw joints. The springs can function as a counterbalance which compensates for the weight of the upper jaw 21. In this regard, the springs can include a build-in load that is complementary (i.e., nearly identical) to the weight of the upper jaw 21, so as to make it possible for the below described actuation member 50 to easily and repeatedly raise and lower the upper jaw to create a chomping motion. As shown, when the jaw is in the closed position, the springs will be extended, whereas when the jaw is in the open position, the springs will be retracted.

In one embodiment, an opaque cover 35 can be positioned along the back portion of the upper and lower jaws. The cover can include a similar color and/or marking as the skull, and can function to hide the appearance of the springs, 30, and the below described push rod 53, when the device is in operation. The cover 35 can preferably be secured along the back side of the skull via strips of hook and loop material 36 (See FIG. 3, wherein the upper portion of the cover is removed for ease of illustration). Of course, any number of other known connectors can also be utilized to secure the cover to the skull in a non-permanent manner.

Although described above with respect to particular jaw elements, this is for illustrative purposes only, as any number of other devices can be substituted for the above described components. For example, any number of hinges, such as spring loaded hinges, for example can be utilized in conjunction with, or in place of the above described elements.

Figure 4:
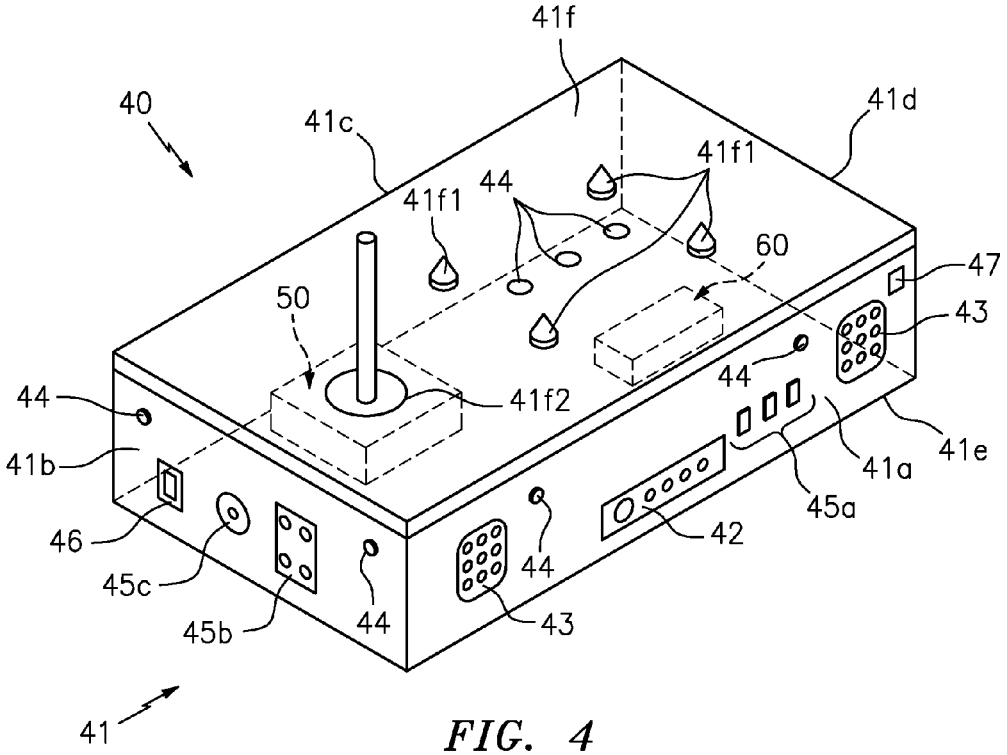
FIG. 4 is a perspective view of the pedestal control box of the novelty chomping device, in accordance with one embodiment of the invention.

FIG. 4 illustrates one embodiment of the pedestal control box 40, that functions to house the electrical and mechanical components that operate the skull, while serving as a platform on which the skull can be mounted. In one embodiment, the pedestal control box 40, can include a main body 41, that houses a controller 60, that is in communication with a radio 42, one or more speakers 43, one or more lights 44, an input/output unit 45, a power unit 46, an actuation unit 50, and an optional motion sensor 47.

In one embodiment, the main body 41 can include a generally rectangular shaped member having a plurality of side panels 41*a*, 41*b*, 41*c*, and 41*d*, that are interposed between a bottom panel 41*e*, and a removable top panel 41*f*. Each of these panels defining a generally hollow interior space for housing the device components. In the preferred embodiment, the main body can be constructed from a sturdy material such as wood, for example, however, any number of other known construction materials such as injection molded plastic, various metals, PVC and/or composites, for example, are also contemplated. Although described above as including a particular shape, this is for illustrative purposes only, as the main body can include any number of different shapes and sizes, and can be adorned with an unlimited amount of decorative elements such as colors, markings, logos, and the like.

As noted above, the skull 20 is preferably mounted onto the top panel 41*f* of the pedestal. As such, the top panel can include any number of connectors 41*f*1 which can engage the bottom jaw 22 of the skull, and secure the same thereon. Several nonlimiting examples of connectors can include, for example, nut and bolt assemblies, strong magnetic elements, adhesives and/or tethers, such as nylon cable ties, for example. The process and methodology for securing two objects together utilizing a connector is extremely well known in the art, and need not be repeated here. Additionally, an aperture 41*f*2 can be disposed along the top panel through which the below described push rod 53 can extend.

Although the following elements 42-60 are illustrated in FIG. 4 as being located at specific locations along and within the main body 41, this is for ease of illustration only. As such, each of the below components can be positioned along any portion of the main body without limitation.

The radio 42 can include any sound producing device, and can preferably comprise a commercially available AM, FM and/or satellite radio receiver. The radio can further include any number of additional components such as a CD/DVD player, and/or an external device access ports for interfacing with devices such as a USB stick, and/or an MP3 player, among others, for example. The radio can be in direct communication with one or more audio speakers 43 which can function in a conventional manner to play the output of the radio.

Each of the one or more lights 44 and the above described eyes 23, can preferably include a light emitting diode (LED). The LED(s) can also be disposed along various surfaces of the main body 41 so as to provide visual stimulation during device operation. In this regard, each of the lights 44 can include any number of different colors, and can function to flash, or remain illuminated, based on an instruction from the controller. Of course, the device is not limited to the use of LED's, as any other form of light producing devices are also contemplated.

Several input/output units can be disposed along the main body 41. Each of these units can function in various manners to affect the functionality of the device. For example, one input/output unit can include the illustrated switches/buttons 45*a* which can act to accept user inputs and provide instructions to the controller. In this regard, the switches can control an operation of the actuation unit 50, the lights 44, the motion sensor 47, and/or to switch the device 10 between an ON and OFF operating state. Another example of a suitable input/output unit can include the external speaker ports 45*b*, and/or microphone input port 45*c*. Each of these devices functioning to transmit or receive audio signals, respectively with an external source.

The power unit 46 can function to receive, generate and/or convert an electrical input for use by the device components. In the preferred embodiment, each of the device components can be powered using direct current (DC). As such, the power unit 46 can include a DC receptacle for engaging a DC power source such as a car battery, for example. Additionally, the power unit 46 can also include one or more batteries which can function to provide the necessary power requirements to the device. In another embodiment, the power unit 46 can also include a common A/C electrical power transformer and cord capable of allowing the device 10 to be powered from a standard electrical outlet.

One or more motion sensors 47 can be included within the device in order to detect movement within a desirable proximity to the device. In one embodiment, the motion sensor 47 can include a commercially available infrared motion sensor which can be positioned along the main body, and can act to detect movement nearby. Upon detecting movement, the sensor can notify the controller 60, wherein the device can be automatically activated for a predetermined or user specified period of time.

Figure 5A:
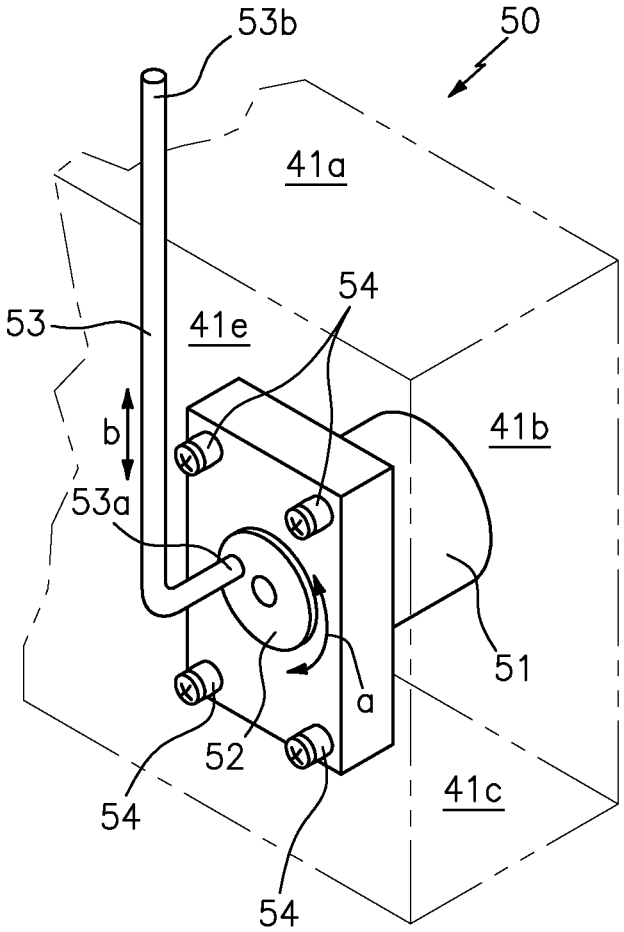
FIG. 5A is a cutout view of the actuation unit of the novelty chomping device, in accordance with one embodiment of the invention.

FIG. 5A is a cutout view of the actuation unit 50 described above with respect to FIG. 4. In the preferred embodiment, the unit 50 can include a 12V variable speed DC motor 51 that is coupled to a power disc/cam 52 along its axle. An elongated push rod/follower 53 can be connected to the power disc at a first end 53*a*. The unit 50 can be securely connected onto the bottom panel 41*e* of the pedestal control box, and can include any number of vibration suppressors 54, such as rubber grommets, for example, to prevent device components from vibrating during device operation. The actuation unit 50 can be in communication with the controller 60, and the power unit 46 to receive operating instructions and power, respectively.

Figure 5B:
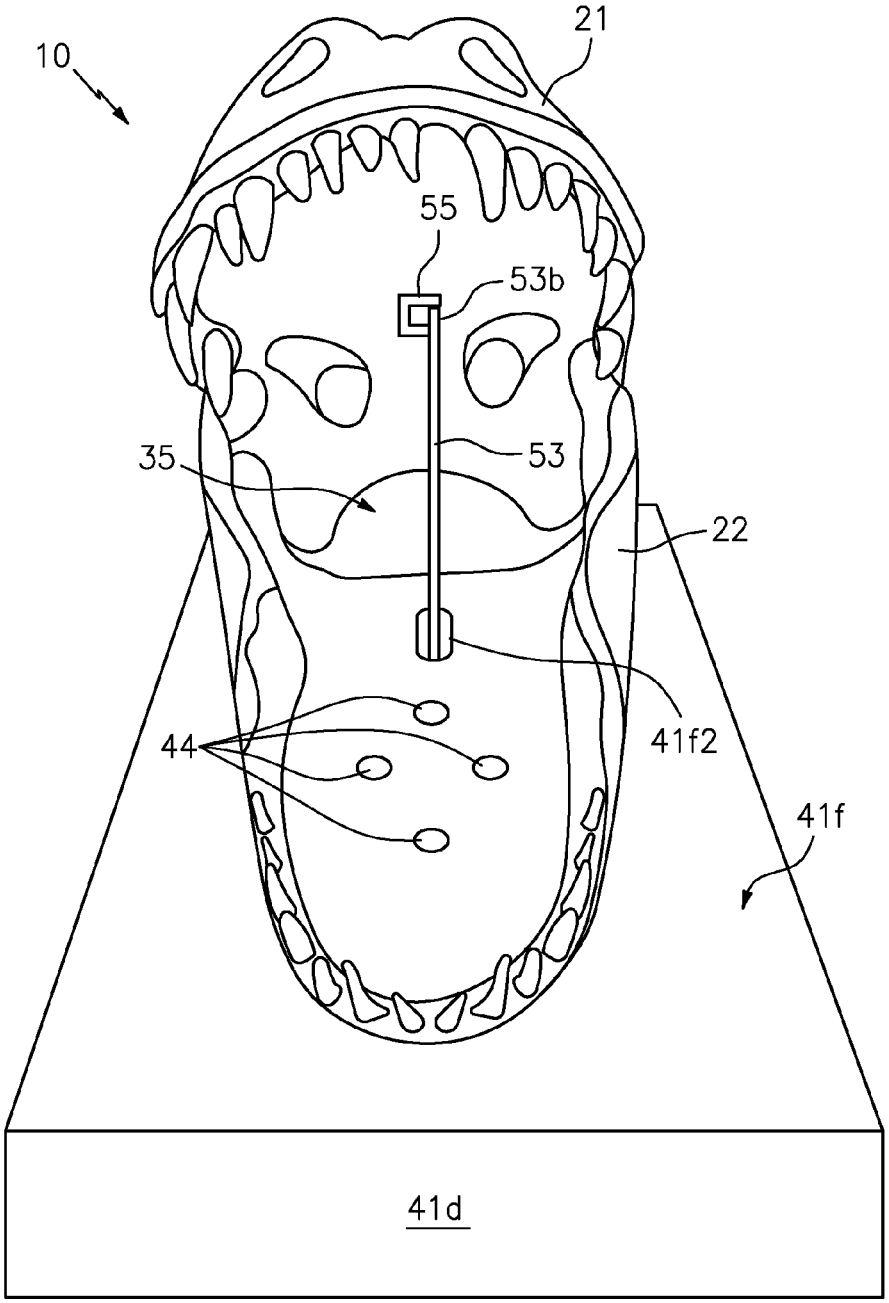
FIG. 5B is a front view of the skull of the novelty chomping device in an open position, in accordance with one embodiment of the invention.

As shown best in FIG. 5B, the push rod 53 can extend through the aperture 41*f*2, and the second end 53*b* can be can be removably secured to the bottom surface of the upper jaw 21 via a connector 55. In operation, the motor 51 can impart a rotational force, (See arrow a of FIG. 5A) onto the power disc 52. Owing to the arrangement of the rod and disc, this force is transitioned into a linear up and down motion on the rod 53 (see arrow b). The up and down movement of the rod works in conjunction with the above described springs 30 and jaw joints 21*a* and 22*a*, to transition the skull between the open position (FIG. 2) and the closed position (FIG. 1). When performed repeatedly, this open and closing movement creates a chomping motion.

Although described above with respect to particular components, this is but one possible implementation of the actuation unit. In this regard, any number of other known devices capable of imparting a lifting and closing force onto the upper jaw 21 can also be utilized herein. One nonlimiting example includes a commercially available DC powered linear actuator, for example.

The controller 60 can be positioned within the pedestal control box 40, and can communicate with, and control the operation of, each of the above described components. In one embodiment, the controller 60 can include a processor 61 that is conventionally connected to an internal memory 62, a timer module 63, a receiver 64, a modulation unit 65, and an internal communication unit 66.

Although illustrated as separate elements, those of skill in the art will recognize that one or more system components may be, or include one or more printed circuit boards (PCB) containing an integrated circuit or circuits for completing the activities described herein. The CPU may be one or more integrated circuits having firmware for causing the circuitry to complete the activities described herein. Of course, any number of other components capable of performing the below described functionality can be provided in place of, or in conjunction with the below described controller elements.

The processor/CPU 61 can act to execute program code stored in the memory 62 in order to allow the device to perform the functionality described herein. Likewise, a timer module 63 can be provided, and can function to accurately measure the passage of time. As described herein, the timer module can be provided as a function of the processor or can include a separate physical circuit. In either instance, processors and timers are extremely well known in the art, therefore no further description will be provided.

Figure 6:
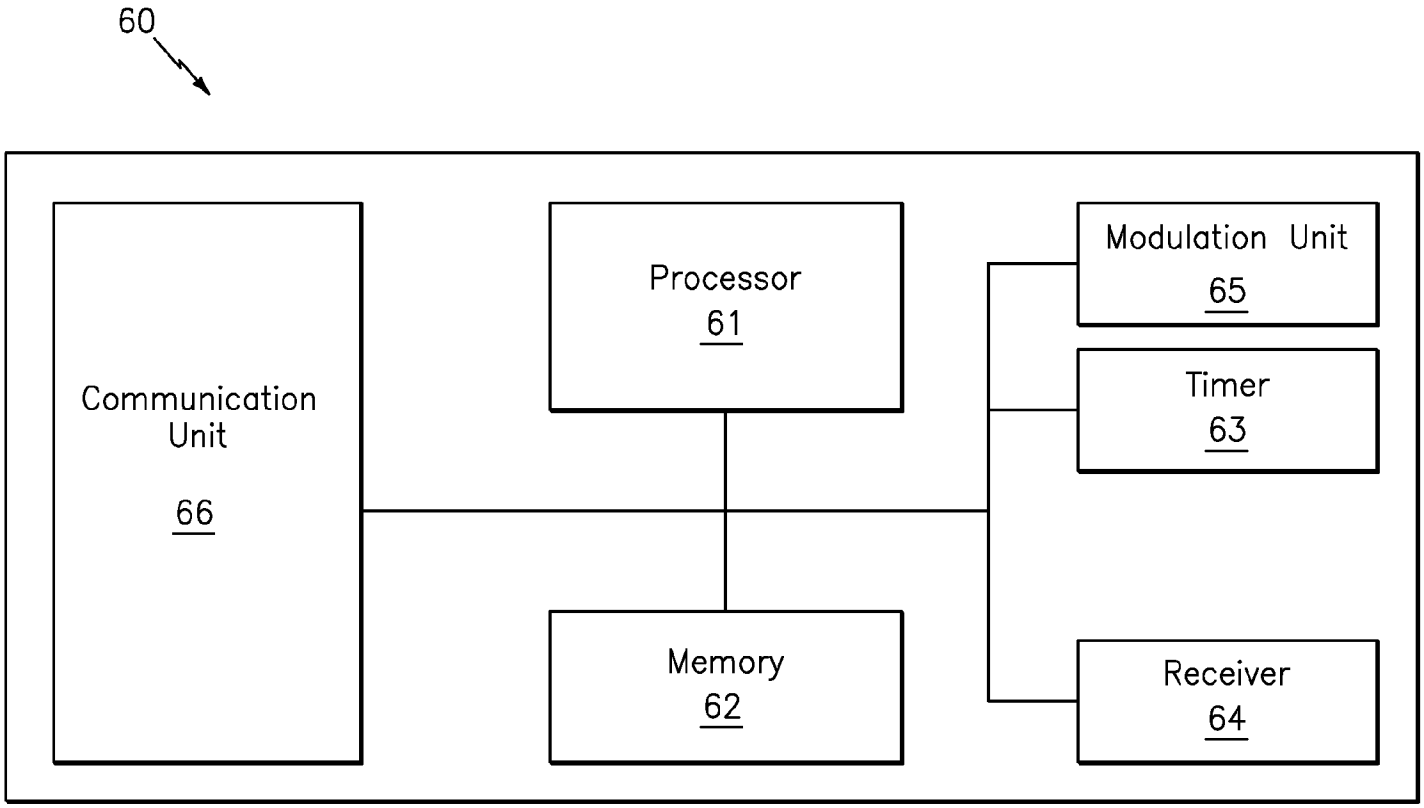
FIG. 6 is a simplified block diagram of the controller of the novelty chomping device, in accordance with one embodiment of the invention.

Memory 62 can act to store operating instructions in the form of program code for the processor 61 to execute. Although illustrated in FIG. 6 as a single component, memory 62 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 62 can also include one or more cache memories that provide temporary storage of at least some program code in order to reduce the number of times program code must be retrieved from the bulk storage device during execution. Each of these devices are well known in the art.

The receiver 64 can act to receive a wireless signal from an outside device such as the remote control unit 15. In one preferred embodiment, the receiver can include a variable radio wave receiver having a unique radio frequency chip capable of receiving and translating a plurality of independent radio frequencies which can be sent from the remote control device, and can deliver the same to the processor and/or the memory 62.

Although described above as using radio transmission, reception and frequencies, other communication mediums and their associated components are also contemplated. For example, infrared (IR), Bluetooth, RFID, microwave and other known communication mediums can also be utilized without deviating from the scope and spirit of the inventive concepts disclosed herein.

The modulation unit 65 can be provided as a function of the processor or as a separate component. The modulation unit can include a frequency and/or amplitude detection device and/or meter which can receive a signal and determine attributes of the same. In one embodiment, the modulation unit can be in communication with the radio so as to receive and interpret an output of the same.

The internal communication unit 66 can function to provide a communications link between the processor 61 and each of the radio/speakers 42 and 43, the lights 44, the input/output units 45, the power unit 46, the actuation unit 50, and/or the motion sensor 47. In this regard, the internal communication unit can include, for example, an internal bus, USB port, or other such hardware capable of providing a direct link between the various components. Although not specifically illustrated, each of the above described components can be physically connected to the communication unit via communication cables or other such devices. Of course any other means for providing the two way communication can also be utilized herein, and can be embodied onto any medium such as a printed circuit board, for example.

In operation, the device can function to move the jaws in a chomping motion, play music and/or provide visual effects through the lights, when activated by one or both of the remote control unit 15 or any of the switches 45*a*. In one embodiment, the modulation unit 65 can function in conjunction with the processor, the memory and the radio to vary the operation of the lights 44 and/or the actuation unit 50 based on the frequency of an audio input signal.

Figure 7:
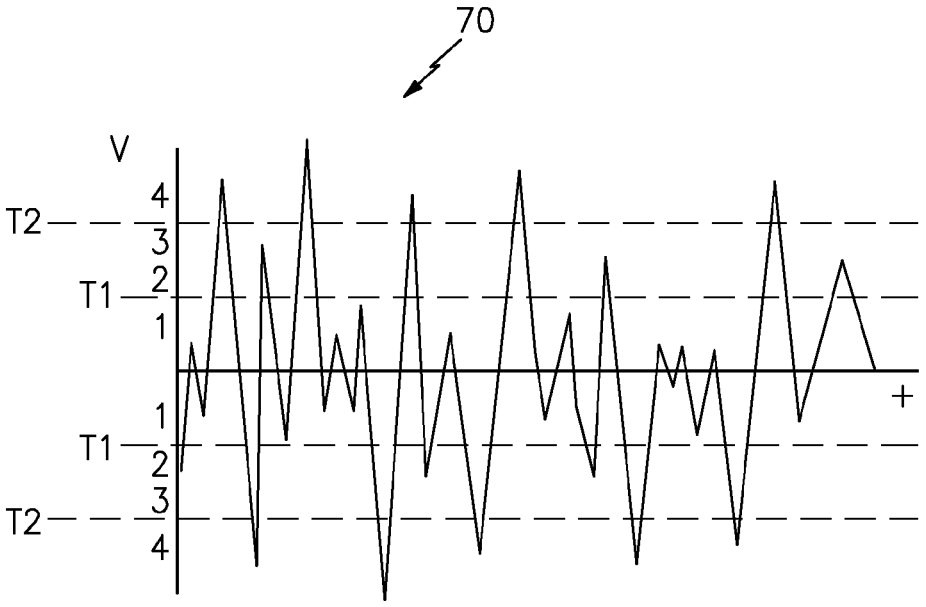
FIG. 7 is an exemplary audio signal which can be interpreted by the modulation unit of the novelty chomping device, in accordance with one embodiment of the invention.

As shown in FIG. 7, the signal 70 can be generated by the radio 42, or can be received from an external source such as the microphone input 45*c*, for example. In this regard, the system can function to move the jaw 21 and/or flash one or more of the lights 44 when the received audio signal is at, above, or below a certain threshold T1 and T2, respectively. In this regard, the system can operate in a unique manner each time a different song or other audio file is played on the system.

In another embodiment, the timer 63 and motion sensor 47 can work in conjunction with each other. As such, the controller can include functionality wherein upon detecting movement by the motion sensor, the processor can initiate the music, lights or actuation unit for a predetermined period of time, as counted by the timer. When the time has passed, and no continued motion is detected, the system can reset and await detection of additional movement. Such a feature can allow the device 10 to provide interactive amusement to users.

Finally, and although not specifically illustrated, any number of other system components can also be provided. Several examples include cooling fans, circuit breakers, fuses, electrical cords, and/or shipping containers for allowing the device to be broken down, shipped and displayed in a safe and secure manner.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that two or more individually identified elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A novelty chomping device, comprising:
a skull having an upper jaw and a lower jaw; and
a pedestal control box that includes
a plurality of panels that define an interior space,
a radio and at least one speaker that are in communication with one or more of the plurality of panels,
one or more lights that positioned along one or more of the plurality of panels,
an actuation unit that is in communication with each of the control box and the skull, said actuation unit functioning to transition the skull between an open position and a closed position, and
a controller that is disposed within the control box, said controller functioning to control an operation of each of the radio, the one or more lights and the actuation unit.

2. The device of claim 1, further comprising:
a remote control unit that is in wireless communication with the controller.

3. The device of claim 1, wherein the skull includes the shape of an alligator skull.

4. The device of claim 1, wherein the skull consists of:
a genuine alligator skull.

5. The device of claim 1, wherein the skull further includes:
a pair of eyes that are disposed along the upper jaw, and
each of said eyes further includes a light that is in communication with the controller.

6. The device of claim 1, wherein the controller further includes:
a modulation unit that functions to selectively activate one or more of the lights and the actuation unit based on an audio input signal.

7. The device of claim 6, wherein the audio input signal is generated by the radio.

8. The device of claim 1, wherein the radio comprises:

a radio wave receiver that functions to receive at least one of an AM signal, an FM signal and a satellite signal.

9. The device of claim 8, wherein the radio further includes at least one of a CD player, a DVD player, and an external device access port.

10. The device of claim 1, wherein the actuation unit comprises:

a DC powered motor having an axle;

a power disc that is in communication with the axle; and a push rod having a first end that is in communication with the power disc.

11. The device of claim 10, wherein the push rod further includes a second end that is in communication with a bottom surface of the upper jaw of the skull, and wherein the motor imparts a rotational force onto the power disc, and the push rod imparts a linear force onto the upper jaw of the skull.

12. The device of claim 11, wherein the pedestal control box further includes a top panel having an aperture located thereon, and the second end of the push rod extends through the aperture.

13. The device of claim 1, wherein each of the lights include a light emitting diode that functions to produce a colored lighting effect.

14. The device of claim 1, further comprising:

one or more input/output units that are positioned along at least one of the plurality of panels, and function to accept control inputs from a user.

15. The device of claim 1, further comprising:

a motion sensor that is disposed along one of the plurality of panels, said sensor functioning to detect movement near the device and to notify the controller of the same.

* * * * *